US012325496B1

(12) United States Patent
Zhou

(10) Patent No.: US 12,325,496 B1
(45) Date of Patent: Jun. 10, 2025

(54) FLOATING BODY CAPABLE OF MOVING ON WATER

(71) Applicant: Tuhui Shengchuang Enterprise Management (Suzhou) Partnership (Limited Partnership), Suzhou (CN)

(72) Inventor: Wenting Zhou, Suzhou (CN)

(73) Assignee: TUHUI SHENGCHUANG ENTERPRISE MANAGEMENT (SUZHOU) PARTNERSHIP (LIMITED PARTNERSHIP), Suzhou (CN)

( * ) Notice: Subject to any disclaimer, the term of this patent is extended or adjusted under 35 U.S.C. 154(b) by 0 days.

(21) Appl. No.: 19/034,313

(22) Filed: Jan. 22, 2025

(30) Foreign Application Priority Data

Jan. 9, 2025 (CN) ..... 202520052247.1

(51) Int. Cl.
*B63B 43/00* (2006.01)
*B63B 79/40* (2020.01)

(52) U.S. Cl.
CPC ..... *B63B 43/00* (2013.01); *B63B 79/40* (2020.01)

(58) Field of Classification Search
CPC ..... B63B 35/00; B63B 35/32; B63B 43/00; B63B 79/40; E04H 4/12; E04H 4/1209; E04H 4/1218; E04H 4/1263
USPC ..... 114/256, 257, 266, 267, 221, 382
See application file for complete search history.

(56) References Cited

U.S. PATENT DOCUMENTS

| | | | | |
|---|---|---|---|---|
| 7,101,475 | B1 * | 9/2006 | Maaske | E04H 4/1263 210/167.2 |
| 10,858,853 | B2 * | 12/2020 | van der Meijden | B08B 1/32 |
| 11,097,814 | B2 * | 8/2021 | Wang | E02B 15/104 |
| 11,112,799 | B2 * | 9/2021 | Simik | C02F 1/008 |
| 11,453,989 | B2 * | 9/2022 | Negron | E02B 15/10 |

* cited by examiner

*Primary Examiner* — Daniel V Venne
(74) *Attorney, Agent, or Firm* — Scully, Scott, Murphy & Presser, P.C.

(57) ABSTRACT

A floating body capable of moving on water is provided. The device includes a recovery container with an accommodation space for accommodating target objects and an opening communicating with the accommodation space; and an agitation device rotatably installed on the floating body, forming a gap with the edge of the opening, the projection height of the gap on a vertical plane being within a threshold range, the gap being configured to allow the target objects to pass through and enter the accommodation space.

19 Claims, 2 Drawing Sheets

FLOATING BODY CAPABLE OF MOVING ON WATER

CROSS-REFERENCE TO RELATED APPLICATION(S)

The disclosure claims the priority to Chinese Patent Application No. 202520052247.1, filed with the China National Intellectual Property Administration (CNIPA) on Jan. 9, 2025, which is hereby incorporated by reference in its entirety.

FIELD

The disclosure relates to, but is not limited to, the field of robotics, and particularly pertains to a floating body that can achieve movement on water surfaces.

BACKGROUND

In related prior art, a floating body is an autonomous device primarily used for operations while moving on water surfaces. However, a wide variety of objects with different sizes and shapes on water surfaces. Currently, floating bodies have a single method of handling objects and cannot effectively deal with larger-sized objects, objects stuck in gaps, and so forth. This results in issues such as poor adaptability and low operational efficiency.

SUMMARY

The embodiments of the disclosure provide a floating body capable of moving on water surfaces to address issues such as the limited object handling methods, poor adaptability, and low operational efficiency of floating bodies in related technologies.

The technical solution of the embodiments of the disclosure is implemented as follows.

The embodiments of the disclosure provide a floating body capable of moving on water surfaces. The floating body comprises a recovery container and an agitation device, wherein:

- the recovery container is provided with an accommodation space and an opening communicating with the accommodation space, the accommodation space is used to accommodate target objects;
- the agitation device is rotatably installed on the floating body and forms a gap with the edge of the opening, the projection height of the gap onto a vertical plane is within a threshold range, the gap is configured to allow target objects to pass through and enter the accommodation space.

In the case where a target object becomes stuck in the gap, after the floating body discharges the target object stuck in the gap, the relative distance between the discharged target object and the floating body increases. The target objects comprise pinecone-like objects.

In the embodiments of the disclosure, on the one hand, by setting the projection height of the gap at the opening of the floating body onto a vertical plane within an appropriate threshold range, the floating body can not only efficiently handle various objects of different sizes and shapes on the water surface but also reduce the discharge of objects that have already entered the accommodation space, thereby improving the floating body's adaptability on water surfaces; on the other hand, by increasing the relative distance between the floating body and the object after discharging the object stuck in the gap, not only is efficient discharge of stuck pinecone-like objects achieved, reducing the likelihood of abnormalities in the floating body, but also the possibility of pinecone-like objects becoming stuck in the gap again is reduced, achieving targeted handling of pinecone-like objects. This broadens the methods of handling objects while also improving operational efficiency.

In some embodiments, the minimum value of the threshold range is 0.5 cm, and the maximum value of the threshold range is 4.5 cm.

In the embodiments of the disclosure, by setting the projection height of the gap at the opening of the floating body onto a vertical plane within the range of 0.5 to 4.5 cm, it is possible to efficiently handle various objects of different sizes and shapes while ensuring water flow smoothness. Additionally, it can effectively intercept larger objects (such as bottles), thereby improving the floating body's processing efficiency, adaptability, and compatibility in complex environments. At the same time, the number of jams in the floating body can be effectively reduced, lowering the possibility of abnormalities due to object jams.

In some embodiments, the agitation device comprises a shaft and blades. The shaft is rotatably installed on the recovery container, and the blades are disposed on the shaft and can rotate along with the shaft. The blades extend in the radial direction of the shaft. In the case where a target object enters the gap, the shaft drives the blades to rotate in a first direction, thereby allowing the target object to enter the accommodation space. In the case where a target object becomes stuck in the gap, the shaft drives the blades to rotate in a second direction, thereby discharging the target object from the gap. The second direction is opposite to the first direction.

In the embodiments of the disclosure, by driving the blades to rotate in different directions using the shaft to handle pinecone-like objects within the gap, targeted handling of pinecone-like objects is achieved, reducing the likelihood of motor burnout, operational abnormalities, and other issues in the floating body due to jams.

In some embodiments, there are a plurality of blades, and the plurality of blades are spaced apart and evenly arranged along the peripheral direction of the shaft.

In the embodiments of the disclosure, by evenly arranging multiple blades along the peripheral direction of the shaft, it is possible to ensure that the collection and pushing of objects by the floating body during operation are more uniform and efficient. Additionally, it can reduce the occurrence of idling and omissions during the floating body's operation, improving operational effectiveness. At the same time, it can also reduce wear on the motor caused by uneven loading. In some embodiments, increasing the relative distance between the discharged target object and the floating body comprises: the floating body remaining stationary relative to the water surface; and the agitation device rotating to discharge the target object from the gap, causing the discharged target object to move in a direction away from the floating body.

In the embodiments of the disclosure, by keeping the floating body stationary and moving the pinecone-like object to increase the distance between them, the possibility of the pinecone-like object becoming stuck in the gap again is reduced, achieving targeted handling of pinecone-like objects. This broadens the methods of handling objects while also improving operational efficiency.

In some embodiments, the floating body further comprises a power device configured to provide power for the movement of the floating body. Increasing the relative distance between the discharged target object and the floating body comprises: the agitation device rotating to discharge the target object from the gap, causing the discharged target object to fall into the water and then remain stationary relative to the water surface; and the power device driving the floating body to perform a first action, causing the floating body to move in a direction away from the target object.

In the embodiments of the disclosure, by keeping the pinecone-like object stationary and moving the floating body to increase the distance between them, the possibility of the pinecone-like object becoming stuck in the gap again is reduced, achieving targeted handling of pinecone-like objects. This broadens the methods of handling objects while also improving operational efficiency.

In some embodiments, the floating body further comprises a power device configured to provide power for the movement of the floating body. Increasing the relative distance between the discharged target object and the floating body comprises: the agitation device rotating to discharge the target object from the gap, causing the discharged target object to move in a direction away from the floating body; and the power device driving the floating body to perform a second action, causing the floating body to move in a direction away from the target object.

In the embodiments of the disclosure, by moving the floating body and the pinecone in opposite directions to increase the distance between them, the possibility of the pinecone-like object becoming stuck in the gap again is reduced, achieving targeted handling of pinecone-like objects. This broadens the methods of handling objects while also improving operational efficiency.

In some embodiments, before increasing the relative distance between the discharged target object and the floating body, it further comprises: reducing the relative distance between the discharged target object and the floating body.

In the embodiments of the disclosure, by reducing the distance between the floating body and the pinecone-like object, the floating body pushes the pinecone to further increase the distance between them, further reducing the possibility of the pinecone-like object becoming stuck in the gap again and achieving targeted handling of pinecone-like objects.

In some embodiments, the floating body further comprises a power device configured to provide power for the movement of the floating body. Reducing the relative distance between the discharged target object and the floating body comprises: the agitation device rotating to discharge the target object from the gap, causing the discharged target object to move in a direction away from the floating body; and the power device driving the floating body to perform a third action, causing the floating body to move in a direction towards the target object.

In the embodiments of the disclosure, in the case where the pinecone-like object moves away from the floating body, by moving the floating body in the direction of the pinecone-like object to reduce the distance between them, the floating body pushes the pinecone to further increase the distance between them, further reducing the possibility of the pinecone-like object becoming stuck in the gap again and achieving targeted handling of pinecone-like objects.

In some embodiments, the floating body further comprises a power device configured to provide power for the movement of the floating body. Reducing the relative distance between the discharged target object and the floating body comprises: the agitation device rotating to discharge the target object from the gap, causing the discharged target object to fall into the water and then remain stationary relative to the water surface; and the power device driving the floating body to perform a fourth action, causing the floating body to move in a direction towards the target object.

In the embodiments of the disclosure, after the pinecone-like object falls into the water and becomes stationary, by moving the floating body in the direction of the pinecone-like object to reduce the distance between them, the floating body pushes the pinecone to further increase the distance between them, further reducing the possibility of the pinecone-like object becoming stuck in the gap again and achieving targeted handling of pinecone-like objects.

REFERENCE NUMERALS

11-Recovery Container, 12-Agitation Device, 13-Power Device, 14-Gap, 111-Accommodation Space, 112-Opening, 113-Bottom Plate, 114-Side Plate, 115-Water Leakage Hole, 121-Shaft, 122-Blade, H-Projected Height, A-width direction, B-length direction.

DESCRIPTION OF EMBODIMENTS

The disclosure will be further described below in detail in conjunction with the accompanying drawings and embodiments.

Unless otherwise defined, all technical and scientific terms used herein have the same meanings as commonly understood by those skilled in the technical field to which this application pertains. The terminology used in the specification of this application is for the purpose of describing specific embodiments only and is not intended to limit the disclosure.

In related prior art, a float is an autonomous device primarily used for operations while moving on water surfaces. These surfaces often contain a wide variety of objects with different sizes and shapes. Currently, floats adopt the same processing method for all objects without targeted measures, leading to issues such as limited processing methods. Additionally, large-sized objects, such as pinecones, may get be stuck in gaps, potentially causing motor burnout, malfunctioning of the float, and other abnormalities. Therefore, floats struggle to effectively handle large-sized objects or objects stuck in gaps. Even if some floats can eject objects stuck in gaps, these objects may easily become stuck again, resulting in poor adaptability and low operational efficiency.

Embodiments of the disclosure provide a float capable of achieving surface mobility. On the one hand, by setting the projected height of the gap at the opening of the floating body within an appropriate threshold range on a vertical plane, the float can efficiently process various objects of different sizes and shapes on the water surface while reducing the ejection of objects that have entered the accommodation space, thereby enhancing the adaptability of the floating body on the water surface; on the other hand, by increasing the relative distance between the object and the gap after ejecting the object stuck in the gap, not only is the efficient ejection of stuck pinecone-like objects achieved, reducing the likelihood of float abnormalities, but also the possibility of pinecone-like objects becoming stuck in the gap again is decreased, enabling targeted processing of such objects. This broadens the processing methods for objects while also improving operational efficiency.

Figure 1:
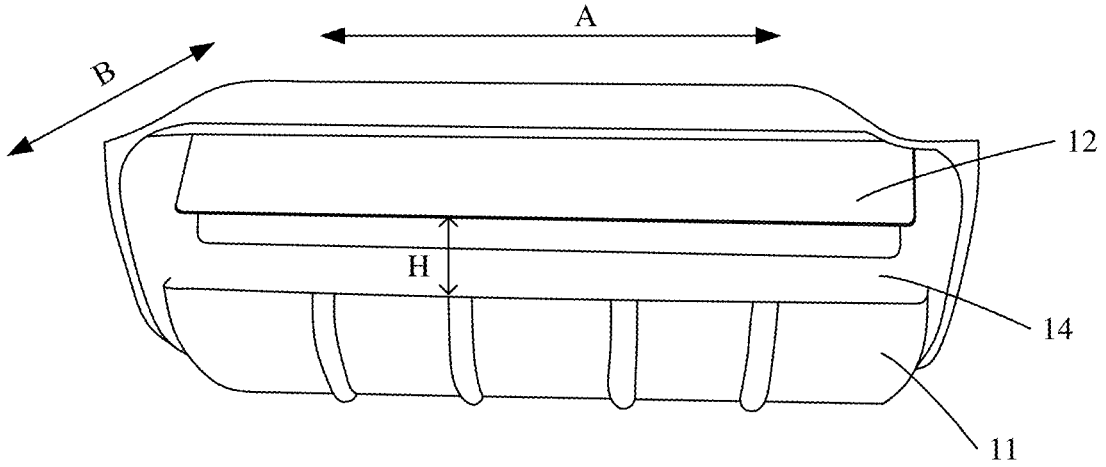
FIG. 1 is a three-dimensional structural schematic diagram of a float capable of achieving surface mobility in an embodiment of the disclosure.

FIG. 1 is a three-dimensional structural schematic diagram of a float capable of achieving surface mobility in an embodiment of the disclosure. As shown in FIG. 1, the float comprises a recovery container 11 and a agitation device 12.

The recovery container 11 has an accommodation space and an opening communicating with the accommodation space, and the accommodation space is used for accommodating target objects. The agitation device 12 is rotatably installed on the float and forms a gap with the edge of the opening, the projected height of the gap on a vertical plane is within a threshold range, and the gap is used to allow target objects to pass through and enter the accommodation space.

In the case where a target object is stuck in the gap, after the float ejects the target object from the gap, the relative distance between the ejected target object and the float increases. The target objects comprise pinecone-like objects.

The floating body is an autonomous device capable of moving autonomously in water and completing corresponding tasks autonomously without external manual input and control. The shape of the floating body can be any suitable shape, such as circular, square, etc. In some embodiments, part of the body is circular, and another part is square. The material of the body can be any suitable material, such as metal. The embodiments of the disclosure do not limit the shape, material, color, etc., of the body.

The recovery container can be any suitable part capable of realizing storage functionality, such as a storage box, storage basket, etc. The recovery container can be fixed in the body or removably set in the body. The shape of the recovery container can be any suitable shape, such as circular, square, etc. The material of the recovery container can be any suitable material. During an implementation, the embodiments of the disclosure do not limit the shape, material, color, etc., of the recovery container.

In some embodiments, the recovery container 11 is removably disposed at the bottom of the body. After the accommodation space accommodates a certain amount of objects, the objects in the accommodation space are cleaned by removing the recovery container.

In some embodiments, the recovery container 11 further comprises a removable or rotatable bottom plate. During an implementation, after the accommodation space accommodates a certain amount of objects, the objects in the accommodation space are cleaned by rotating the bottom plate.

In some embodiments, multiple water leakage holes are arranged at intervals on the bottom and/or sides of the recovery container 11 to drain excess water from the accommodation space. During an implementation, water flows through the opening of the recovery container and out from the water leakage holes, which can reduce the resistance of the water flow and improve the flexibility of the movement of the floating body.

The shape of the opening can be any suitable shape, such as square, circular, etc. The size of the opening can be any suitable size. For example, the top of the recovery container constitutes the opening. Alternatively, part of the top of the recovery container constitutes the opening. In another example, part of the top and part of the sides of the recovery container constitute the opening. In some embodiments, the opening may comprise an upper edge, a lower edge, etc.

Figure 2:
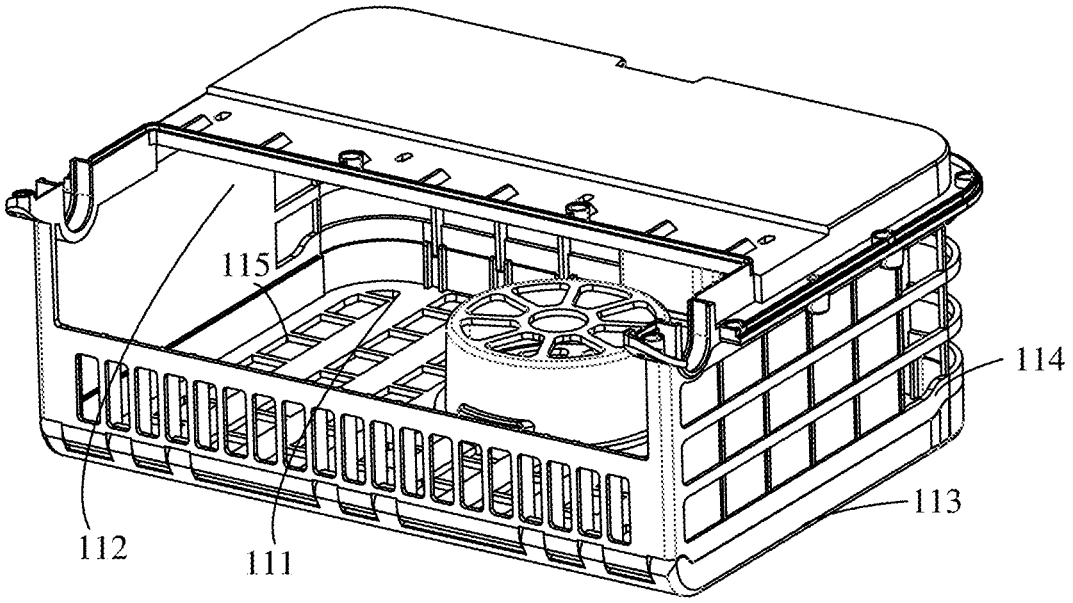
FIG. 2 is a three-dimensional structural schematic diagram of a recovery container in an embodiment of the disclosure.

FIG. 2 is a three-dimensional structural schematic diagram of a recovery container in an embodiment of the disclosure. As shown in FIG. 2, the recovery container 11 comprises an accommodation space 111, an opening 112, a bottom plate 113, and multiple side plates 114. The bottom plate 113 is uniformly provided with water leakage holes 115.

Target objects can be objects of any suitable size and shape, such as non-pinecone objects and pinecone-like objects. Non-pinecone objects can comprise but are not limited to fine debris (e.g., insects, hair, etc.), leaves, plastic bag fragments, etc. Pinecone-like objects can comprise but are not limited to pinecones, nuts, and other hard objects.

The agitation device 12 can be any suitable device capable of performing this function. For example, the agitation device can comprise a shaft and blades. Alternatively, the agitation device can comprise a stirring lever.

In some embodiments, the agitation device 12 comprises a shaft and blades. The shaft is rotatably installed on the recovery container 11, and the blades are disposed on the shaft and can rotate along with the rotation of the shaft, extending in the radial direction of the shaft. When a target object enters the gap, the shaft drives the blades to rotate in a first direction, thereby allowing the target object to enter the accommodation space. In the case where the target object is stuck in the gap, the shaft drives the blades to rotate in a second direction, thereby ejecting the target object from the gap. The second direction is opposite to the first direction.

The first direction can refer to the direction of forward rotation of the shaft, and the second direction can refer to the direction of reverse rotation of the shaft.

The number of blades can be at least one. The shape of the blades can be any suitable shape, such as rectangular, spiral, etc. During an implementation, those skilled in the art can independently set the number, shape, etc., of the blades according to actual needs, and the embodiments of the disclosure do not impose limitations.

In some embodiments, the number of blades is multiple, and the multiple blades are spaced apart and uniformly arranged along the peripheral direction of the shaft. The number of blades can be 4, 6, 8, etc. The blades can be in the shape of long straight plates. By uniformly arranging multiple blades along the peripheral direction of the shaft, it can not only ensure that the collection and pushing of objects by the floating body during operation are more uniform and efficient but also reduce idling and omission phenomena of the floating body during operation, improving the effectiveness of the operation. At the same time, it can also reduce wear on the motor caused by uneven loads.

In some embodiments, the blades can be fixedly or removably connected to the shaft via connecting parts. The connecting parts can be any suitable parts capable of performing this function, such as connecting rods. In some embodiments, the center around which the multiple blades are arranged is hollow. During the rotation of the shaft, the water flow will be dispersed and flow from the sides of the blades to ensure that the plane of the blades receives uniform force. This can also increase the water flow resistance when the blades rotate, reduce the slipping of the blades in the water flow, and improve the flexibility of the floating body.

Figure 3:
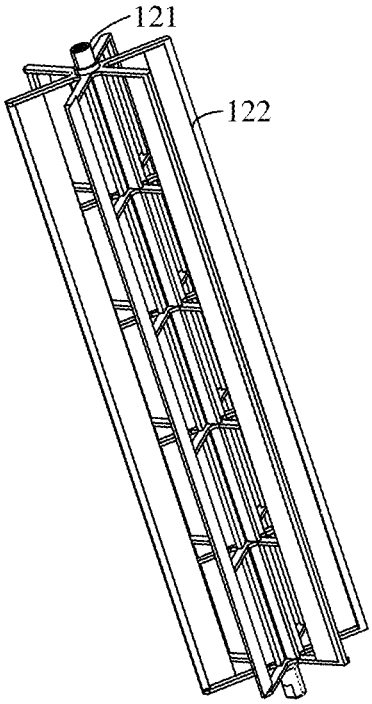
FIG. 3 is a three-dimensional structural schematic diagram of a agitation device in an embodiment of the disclosure.

FIG. 3 is a three-dimensional structural schematic diagram of a agitation device in an embodiment of the disclosure. As shown in FIG. 3, the agitation device 12 comprises a shaft 121 and multiple blades 122, with the multiple blades 122 spaced apart and uniformly arranged along the peripheral direction of the shaft 121.

In the embodiments of the disclosure, by driving the blades to rotate in different directions via the shaft to handle pinecone-like objects within the gap, targeted processing of pinecone-like objects is achieved, reducing the likelihood of motor burnout, abnormal operation, and other issues due to jams in the floating body.

In some embodiments, the minimum value of the threshold range is 0.5 cm, and the maximum value of the threshold range is 4.5 cm.

The vertical plane refers to a plane perpendicular to the horizontal plane. The horizontal plane typically refers to a plane parallel to the ground. During the rotation of the blades, the gap can be formed between the shaft and the edge of the opening, or between the blades and the edge of the opening. During an implementation, the projected height can be any suitable value between 0.5 cm and 4.5 cm. For example, the projected height can be 1.4 cm, 1.45 cm, 1.5 cm, etc.

In some embodiments, if the gap is too small, it can only handle small-sized objects; if the gap is too large, objects that have already entered the recovery container can easily be ejected. Therefore, it is necessary to maintain the gap within a reasonable range, i.e., with a projected height in the vertical plane between 0.5 cm and 4.5 cm.

The beneficial effects of setting the projected height of the gap at the opening of the floating body within the threshold range in the vertical plane are discussed below in terms of multiple dimensions such as effectiveness, dial-in efficiency, jam frequency, cleaning time, etc.

(1) As shown in Table 1 below, it can not only effectively intercept larger foreign objects but also efficiently dial in target objects by setting the projected height of the gap in the vertical plane within the threshold range.

TABLE 1

Passage Effectiveness of Various Types and Sizes of Objects

| Object Type | Size (Diameter/ Thickness) | Passage Effectiveness |
|---|---|---|
| Fine Debris | 0.1-1 cm | Fully Passing |
| Leaves | 2-4 cm | Moderately Passing, Easily Passing by an agitation device |
| Plastic Bag Fragments | 3-5 cm | Flexible Objects Easily Passing |
| Large Objects (Beverage Bottles) | >5 cm | Unable to Enter, Prevents Jamming |

(2) As shown in Table 2 below, when the projected height is smaller, the object Suction Efficiency is higher, suitable for water surface environments with low water flow speeds and primarily fine debris. When the projected height increases to 1.5-3.0 cm, the object Suction Efficiency is high, suitable for water surface environments that consider both water flow speeds and objects of various types, sizes, and shapes. When the projected height increases to 4.5 cm, the object Suction Efficiency slightly decreases, suitable for water surface environments with larger objects.

TABLE 2

Object Suction Efficiency Corresponding to Different Projected Heights

| Projected Height (cm) | Water Flow Rate (liters/minute) | Object Suction Efficiency (%) |
|---|---|---|
| 0.5 | 80 | 90 |
| 1.5 | 120 | 95 |
| 3.0 | 150 | 98 |
| 4.5 | 180 | 90 |

(3) As shown in Table 3 below, when the projected height is set between 0.5 cm and 4.5 cm, it effectively reduces the number of shutdowns due to jamming and shortens the cleaning time of the floating body. Especially when it is between 3.0 cm and 4.5 cm, the number of jamming incidents significantly decreases, and the cleaning time of the floating body is shorter.

TABLE 3

Object Suction Efficiency Corresponding to Different Projected Heights

| Projected Height (cm) | Floating Body Jamming Frequency (times/day) | Cleaning Time (minutes/day) |
|---|---|---|
| 0.5 | 3 | 10 |
| 1.5 | 1 | 5 |
| 3.0 | 0.5 | 3 |
| 4.5 | 0.2 | 2 |

In the embodiment of this application, it not only efficiently processes various objects of different sizes and shapes while ensuring smooth water flow, but also effectively intercepts large-sized objects (such as bottles) by setting the projected height of the gap in the vertical plane between 0.5 and 4.5 cm, thereby improving the processing efficiency of the floating body and enhancing its adaptability and compatibility in complex environments. Additionally, it can effectively reduce the number of jamming incidents in the floating body, lowering the possibility of abnormal operations caused by object jamming.

The methods for the floating body to discharge target objects in the gap can comprise, but are not limited to, at least one of Method 1 and Method 2. Method 1 refers to reversing the rotation of a shaft to drive blades and thereby discharge pinecones-like objects that are stuck in the gap. Method 2 comprises the floating body using impact to shake out pinecones-like objects that are stuck in the gap.

Increasing the relative distance can comprise, but is not limited to, scenarios where the first object is stationary and the second object moves away from the first object, or where the first object and the second object move apart from each other. The first object refers to either the floating body or the target object, and the second object refers to the other of the floating body or the target object.

In some embodiments, increasing the relative distance between the discharged target object and the floating body comprises: keeping the floating body stationary relative to the water surface; and rotating the agitation device to discharge the target object from the gap, causing the discharged target object to move in a direction away from the floating body.

The agitation device rotates with first rotation parameters. During the process of discharging the target object, it can apply a significant force to propel the target object, achieving the purpose of the target object moving away from the floating body after being discharged from the gap. In some embodiments, this force can give the target object a significant initial velocity in the lengthwise direction of the floating body, causing the target object to move away from the floating body.

The first rotation parameters can comprise, but are not limited to, rotational speed and direction. In the embodiments of this application, the likelihood of the pinecone-like objects becoming stuck in the gap again is reduced by keeping the floating body stationary while moving the pinecone-like objects to increase the relative distance between them, enabling targeted processing of these objects. This broadens the methods of handling objects while also improving operational efficiency.

In some embodiments, the floating body further comprises a power device configured to provide power for the movement of the floating body. During an implementation, the power device can be any suitable device capable of fulfilling this function. For example, the power device may comprise a motor and a propeller, with the motor driving the propeller to provide power for the movement of the floating body. Alternatively, the power device may comprise a motor and an impeller, with the multiple blades on the impeller stirring the water to generate significant thrust, meeting the requirements for high-speed and stable operation of the floating body.

In some embodiments, the number of propellers can be at least two. The number of motors can be compatible with the number of propellers. For example, if there are two propellers, the number of motors can be one or two, with one motor driving both propellers or different motors driving different propellers.

In some embodiments, the power device comprises a left propeller and a right propeller, used to enable the floating body to perform actions such as advancing, retreating, turning, and reversing direction. For example, by controlling both the left and right propellers to rotate in reverse, the floating body can perform a retreating action. Alternatively, by controlling the rotational speed of the left propeller to be different from that of the right propeller, the floating body can perform turning or reversing direction actions.

In some embodiments, increasing the relative distance between the discharged target object and the floating body comprises: rotating the agitation device to discharge the target object from the gap, causing the discharged target object to fall into the water and remain stationary relative to the water surface; and using the power device to drive the floating body to perform a first action, causing the floating body to move in a direction away from the target object.

Here, the agitation device rotates with second rotation parameters. During the process of discharging the target object, it can apply a smaller force to achieve the purpose of the target object falling into the water and remaining stationary relative to the water surface. In some embodiments, this force can give the target object a smaller initial velocity in the lengthwise direction of the floating body, causing the target object to remain stationary after falling into the water. During an implementation, this force causes the target object to have no displacement or only a small displacement in the lengthwise direction of the floating body. The small displacement refers to the displacement generated as the target object falls into the water along the outer wall of the recovery container.

The second rotation parameters can comprise, but are not limited to, rotational speed and direction. During an implementation, the second rotation parameters are different from the first rotation parameters. For example, the rotational speed of the second rotation parameters is less than that of the first rotation parameters, while the direction of the second rotation parameters can be the same as that of the first rotation parameters.

The first action can be any suitable action that achieves movement away from the target object. For example, it can be a retreating action relative to the target object. Alternatively, it can be a turning action (such as left turn or right turn) relative to the target object. It can also be a combined action of moving back first and then turning relative to the target object.

In the embodiments of this application, the likelihood of the pinecone-like objects becoming stuck in the gap again is reduced by keeping the pinecone-like objects stationary while moving the floating body to increase the relative distance between them, enabling targeted processing of these objects. This broadens the ways of handling objects while also improving operational efficiency.

In some embodiments, increasing the relative distance between the discharged target object and the floating body comprises: rotating the agitation device to discharge the target object from the gap, causing the discharged target object to move in a direction away from the floating body; and using the power device to drive the floating body to perform a second action, causing the floating body to move in a direction away from the target object.

The agitation device rotates with a third rotational parameter, which can impart a significant force to the target object during the process of ejecting it, thereby propelling the target object to move and achieving the purpose of the target object moving away from the floating body after being ejected from the gap. In some embodiments, this force can impart a relatively large initial velocity to the target object in the length direction of the floating body, causing the target object to move away from the floating body.

The third rotational parameter can comprise, but is not limited to, rotational speed and direction. In some embodiments, this third rotational parameter can be the same as or different from the first rotational parameter.

The second action can be any suitable action that achieves movement away from the target object. For example, it can be a backward movement relative to the target object. Alternatively, it can be a left-turn or a right-turn action relative to the target object. In some embodiments, the second action can be the same as or different from the first action.

In the embodiments of this application, the possibility of pinecone-like objects becoming stuck in the gap again is reduced by moving the floating body and the pinecone in opposite directions to increase the relative distance between them, achieving targeted processing of such objects. This broadens the methods for handling objects while also improving operational efficiency.

Figure 4:
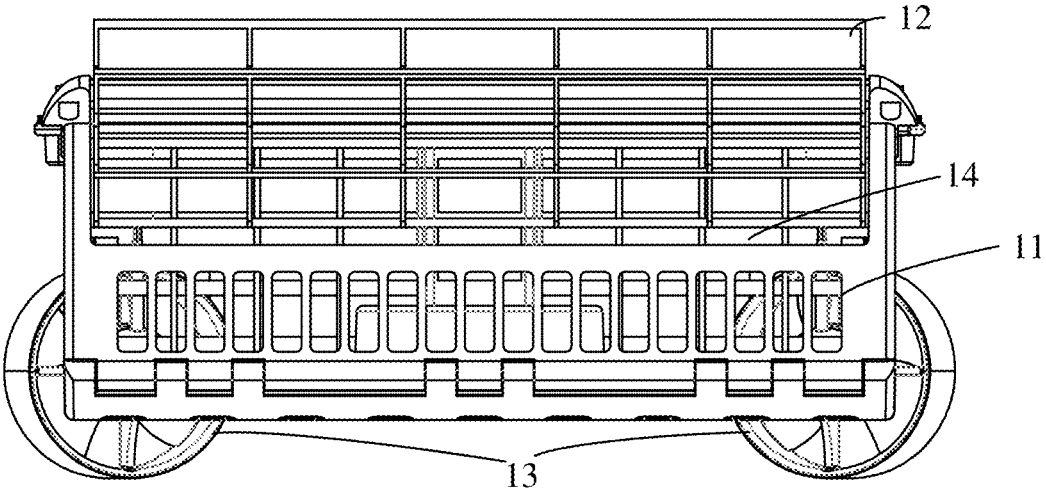
FIG. 4 is a plan view structural schematic diagram of a float capable of achieving surface mobility in an embodiment of the disclosure.

FIG. 4 is a plan view of a floating body capable of moving on water provided in an embodiment of this application. As shown in FIG. 4, the floating body comprises a recovery container 11, an agitation device 12, and a power device 13. The agitation device 12 is located on a first side of the floating body, and the power device 13 is located on a second side of the floating body. The first side and the second side refer to two sides facing away from each other in the length direction B of the floating body.

The recovery container 11 has an accommodation space 111 and an opening 112 communicating with the accommodation space.

The agitation device 12 comprises a shaft and a plurality of blades 122, and a gap 14 is formed between the blades 122 and the lower edge of the opening 112, with the projection height H of the gap 14 on a vertical plane being within a threshold range.

In the case where a pinecone becomes stuck in the gap 14, the shaft drives the blades 122 to rotate in reverse at a relatively high speed to eject the pinecone from the gap 14 and move it in a direction away from the floating body.

The power device 13 drives the floating body to execute a backward movement relative to the pinecone, causing the floating body to move in a direction away from the pinecone.

In some embodiments, before the relative distance between the ejected target object and the floating body increases, it further comprises: reducing the relative distance between the ejected target object and the floating body.

Reducing the relative distance can comprise, but is not limited to, the target object being stationary while the floating body moves towards it, or both the target object and the floating body moving in the same direction, etc., utilizing the water between the floating body and the target object to propel the target object. In this way, the floating body propels the pinecone to move by reducing the relative distance between the floating body and the pinecone-like object, thereby further increasing the distance between them and further reducing the possibility of the pinecone-like object becoming stuck in the gap again, achieving the purpose of targeted processing of such objects.

In some embodiments, reducing the relative distance between the ejected target object and the floating body comprises: rotating the agitation device to eject the target object from the gap, causing the ejected target object to move in a direction away from the floating body; and driving the floating body with the power device to execute a third action, causing the floating body to move in a direction towards the target object.

The agitation device rotates with a fourth rotational parameter, imparting a significant force to the target object during ejection to propel it into motion, achieving the purpose of the target object moving away from the floating body after being ejected from the gap. In some embodiments, this force can impart a relatively large initial velocity to the target object in the length direction of the floating body, causing the target object to move away from the floating body.

The fourth rotational parameter can comprise, but is not limited to, rotational speed and direction. In some embodiments, this fourth rotational parameter can be the same as or different from the third rotational parameter.

The third action can be any suitable action that achieves movement towards the target object. For example, it can be a forward movement relative to the target object. Alternatively, it can be a turning action relative to the target object. During an implementation, this third action propels the water into motion, causing the water to further propel the pinecone away from the floating body, thereby preventing the floating body from hitting the target object or the gap from becoming stuck with the target object again.

In the embodiments of this application, when the pinecone-like object moves away from the floating body, the floating body moves towards the direction of the pinecone-like object to reduce the relative distance between them, allowing the floating body to propel the pinecone to move, thereby further increasing the distance between them and further reducing the possibility of the pinecone-like object becoming stuck in the gap again, achieving the purpose of targeted processing of such objects.

In some embodiments, reducing the relative distance between the ejected target object and the floating body comprises: rotating the agitation device to eject the target object from the gap, causing the ejected target object to fall into the water and remain stationary relative to the water surface; and driving the floating body with the power device to execute a fourth action, causing the floating body to move in a direction towards the target object.

The actuation device rotates with a fifth rotational parameter, applying a relatively small force to the target object during the process of ejecting it, in order to achieve the goal of the target object remaining stationary relative to the water surface after landing in the water. In some embodiments, this force can impart a small initial velocity to the target object along the length of the floating body, enabling the target object to remain stationary after hitting the water. In practice, this force results in no displacement or minimal displacement of the target object along the length of the floating body. The minimal displacement refers to the displacement generated as the target object falls into the water along the outer wall of the recovery container.

The fifth rotational parameter can comprise, but is not limited to, rotational speed and direction. In practice, this fifth rotational parameter can be the same as or different from the second rotational parameter.

The fourth action can be any suitable action capable of achieving movement towards the target object. For example, it could be a forward motion relative to the target object. Alternatively, it could be a steering action relative to the target object. In practice, this fourth action propels the water current, which further pushes the pinecone away from the floating body, thereby preventing the floating body from colliding with the target object or the gap from becoming re-entrapped by the target object. In some embodiments, this fourth action can be the same as or different from the third action.

In the embodiments of this application, after pinecone-like objects have landed and come to rest in the water, the floating body moves in the direction of these objects to reduce the distance between them, causing the floating body to push the pinecone, thereby further increasing the distance between them. This, in turn, further reduces the likelihood of the pinecone-like objects becoming re-entrapped in the gap, achieving the purpose of targeted processing of pinecone-like objects.

In some embodiments, the floating body further comprises a buoyancy device that carries the fuselage, enabling the fuselage to remain balanced on the water surface without sinking. In practice, the buoyancy device can be any suitable device capable of fulfilling this function.

In some embodiments, the floating body can also comprise a sensor system. This sensor system is primarily used to detect obstacle information around the floating body, facilitating efficient and accurate obstacle avoidance by the floating body. Obstacle information can comprise, but is not limited to, the size of obstacles and the distance from obstacles. The sensor system can comprise any suitable sensors capable of fulfilling this function. For example, distance sensors, vision sensors, laser sensors, acceleration sensors, angle sensors, infrared sensors, ultrasonic sensors, etc. In some embodiments, the sensor system can comprise at least one sensor of at least one type. In practice, those skilled in the art can independently choose the type, number, and installation position of the sensors in the sensor system based on actual needs, and the embodiments of this application do not impose limitations.

In some embodiments, the floating body can also comprise a controller primarily used to control the operation of the floating body. The controller can be any suitable part capable of fulfilling control functions, such as an MCU (Microcontroller Unit), CPU (Central Processing Unit), DSP (Digital Signal Processor), microcontroller, etc.

In some embodiments, the operations of the floating body in the water can comprise but are not limited to cleaning, patrolling, rescue, environmental monitoring, environmental remediation, etc. In practice, those skilled in the art can independently set the operations of the floating body based on actual needs, and the embodiments of this application do not impose limitations.

In the embodiments of this application, on the one hand, by setting the projection height of the gap at the opening of the floating body on a vertical plane within an appropriate threshold range, the floating body can not only efficiently handle various objects of different sizes and shapes on the water surface but also reduce the ejection of objects that have already entered the accommodation space, improving the adaptability of the floating body on the water surface; on the other hand, by increasing the relative distance between the floating body and the object after ejecting the object stuck in the gap, it not only achieves efficient ejection of the stuck pinecone-like object, reduces the possibility of abnormal floating body behavior, but also lowers the likelihood of the pinecone-like object becoming re-entrapped in the gap, achieving targeted processing of pinecone-like objects. This broadens the methods of handling objects while also improving operational efficiency.

The above is only a specific embodiment of this application, but the protection scope of this application is not limited to this. Any skilled person in the technical field can easily think of variations or substitutions within the technical scope disclosed in this application, which should be covered within the protection scope of this application. Therefore, the protection scope of this application should be based on the scope of protection of the claims.

The invention claimed is:

1. A floating body capable of moving on water, wherein the floating body comprises a recovery container and an agitation device, wherein:

the recovery container comprises an accommodation space and an opening communicating with the accommodation space, the accommodation space being configured to accommodate a target object;

the agitation device is rotatably mounted on the floating body and forms a gap with an edge of the opening, a projection height of the gap on a vertical plane being within a threshold range, the gap being configured to allow the target object to pass through and enter the accommodation space;

in a case where the target object is stuck in the gap, after the floating body discharges the target object stuck in the gap, a relative distance between the discharged target object and the floating body increases, wherein the target object comprising pinecones and/or nut.

2. The floating body according to claim 1, wherein a minimum value of the threshold range is 0.5 cm, and a maximum value of the threshold range is 4.5 cm.

3. The floating body according to claim 1, wherein the agitation device comprises a shaft and blades, the shaft being rotatably mounted on the recovery container, the blades being provided on the shaft and capable of rotating together with the shaft, the blades extending in a radial direction of the shaft;

in a case where the target object enters the gap, the shaft drives the blades to rotate in a first direction, thereby allowing the target object to enter the accommodation space;

in the case where the target object is stuck in the gap, the shaft drives the blades to rotate in a second direction, thereby discharging the target object from the gap, the second direction being opposite to the first direction.

4. The floating body according to claim 3, wherein the agitation device comprises a plurality of the blades, the plurality of blades being spaced apart and evenly arranged along a peripheral direction of the shaft.

5. The floating body according to claim 1, wherein increasing a relative distance between the discharged target object and the floating body comprises:

the floating body being stationary relative to a water surface;

the agitation device rotating to discharge the target object from the gap, to enable the discharged target object to move in a direction away from the floating body.

6. The floating body according to claim 2, wherein increasing a relative distance between the discharged target object and the floating body comprises:

the floating body being stationary relative to a water surface;

the agitation device rotating to discharge the target object from the gap, to enable the discharged target object to move in a direction away from the floating body.

7. The floating body according to claim 3, wherein increasing a relative distance between the discharged target object and the floating body comprises:

the floating body being stationary relative to a water surface;

the agitation device rotating to discharge the target object from the gap, to enable the discharged target object to move in a direction away from the floating body.

8. The floating body according to claim 4, wherein increasing a relative distance between the discharged target object and the floating body comprises:

the floating body being stationary relative to a water surface;

the agitation device rotating to discharge the target object from the gap, to enable the discharged target object to move in a direction away from the floating body.

9. The floating body according to claim 1, wherein the floating body further comprises a power device configured to provide power for a movement of the floating body, increasing a relative distance between the discharged target object and the floating body comprises:

the agitation device rotating to discharge the target object from the gap, to enable the discharged target object to fall into the water and then becomes stationary relative to a water surface;

the power device driving the floating body to execute a first action, to enable the floating body to move in a direction away from the target object.

10. The floating body according to claim 2, wherein the floating body further comprises a power device configured to provide power for a movement of the floating body, increasing a relative distance between the discharged target object and the floating body comprises:

the agitation device rotating to discharge the target object from the gap, to enable the discharged target object to fall into the water and then becomes stationary relative to a water surface;

the power device driving the floating body to execute a first action, to enable the floating body to move in a direction away from the target object.

11. The floating body according to claim 3, wherein the floating body further comprises a power device configured to provide power for a movement of the floating body, increasing a relative distance between the discharged target object and the floating body comprises:

the agitation device rotating to discharge the target object from the gap, to enable the discharged target object to fall into the water and then becomes stationary relative to a water surface;

the power device driving the floating body to execute a first action, to enable the floating body to move in a direction away from the target object.

12. The floating body according to claim 4, wherein the floating body further comprises a power device configured to provide power for a movement of the floating body, increasing a relative distance between the discharged target object and the floating body comprises:

the agitation device rotating to discharge the target object from the gap, to enable the discharged target object to fall into the water and then becomes stationary relative to a water surface;

the power device driving the floating body to execute a first action, to enable the floating body to move in a direction away from the target object.

13. The floating body according to claim 1, wherein the floating body further comprises a power device configured to provide power for a movement of the floating body, increasing a relative distance between the discharged target object and the floating body comprises:

the agitation device rotates to discharge the target object from the gap, to enable the discharged target object to move in a direction away from the floating body;

the power device driving the floating body to execute a second action, to enable the floating body to move in a direction away from the target object.

14. The floating body according to claim 2, wherein the floating body further comprises a power device configured to provide power for a movement of the floating body, increasing a relative distance between the discharged target object and the floating body comprises:

the agitation device rotates to discharge the target object from the gap, to enable the discharged target object to move in a direction away from the floating body;

the power device driving the floating body to execute a second action, to enable the floating body to move in a direction away from the target object.

15. The floating body according to claim 3, wherein the floating body further comprises a power device configured to provide power for a movement of the floating body, increasing a relative distance between the discharged target object and the floating body comprises:

the agitation device rotates to discharge the target object from the gap, to enable the discharged target object to move in a direction away from the floating body;

the power device driving the floating body to execute a second action, to enable the floating body to move in a direction away from the target object.

16. The floating body according to claim 4, wherein the floating body further comprises a power device configured to provide power for a movement of the floating body, increasing a relative distance between the discharged target object and the floating body comprises:

the agitation device rotates to discharge the target object from the gap, to enable the discharged target object to move in a direction away from the floating body;

the power device driving the floating body to execute a second action, to enable the floating body to move in a direction away from the target object.

17. The floating body according to claim 1, wherein before increasing the relative distance between the discharged target object and the floating body further comprises:

decreasing the relative distance between the discharged target object and the floating body.

18. The floating body according to claim 17, wherein the floating body further comprises a power device configured to provide power for a movement of the floating body, the decreasing of the relative distance between the discharged target object and the floating body comprises:

the agitation device rotating to discharge the target object from the gap, to enable the discharged target object to move in a direction away from the floating body;

the power device driving the floating body to execute a third action, to enable the floating body to move in a direction towards the target object.

19. The floating body according to claim 17, wherein the floating body further comprises a power device configured to provide power for a movement of the floating body, the decreasing of the relative distance between the discharged target object and the floating body comprising:

the agitation device rotating to discharge the target object from the gap, to enable the discharged target object to fall into the water and then becomes stationary relative to a water surface;

the power device driving the floating body to execute a fourth action, to enable the floating body to move in a direction towards the target object.

* * * * *